US006167803B1

(12) United States Patent
Schwelling

(10) Patent No.: US 6,167,803 B1
(45) Date of Patent: Jan. 2, 2001

(54) DOOR ASSEMBLY FOR WASTE-PAPER BALER

(76) Inventor: Hermann Schwelling, Hartmannweg 5, D-88682 Salem (DE)

( * ) Notice: Under 35 U.S.C. 154(b), the term of this patent shall be extended for 0 days.

(21) Appl. No.: 09/296,065

(22) Filed: Apr. 21, 1999

(30) Foreign Application Priority Data

Apr. 21, 1998 (DE) ..... 198 17 807

(51) Int. Cl.[7] ..... B30B 5/00

(52) U.S. Cl. ..... 100/255; 100/53; 100/215; 100/245; 100/246

(58) Field of Search ..... 100/251, 252, 100/255, 246, 240, 245, 215, 229 A, 53

(56) References Cited

U.S. PATENT DOCUMENTS 5,044,271 * 9/1991 Robbins et al. ..... 100/53
5,685,219 * 11/1997 Schwelling ..... 100/255

FOREIGN PATENT DOCUMENTS 297 04 276 U 8/1997 (DE) .

* cited by examiner

*Primary Examiner*—Peter Vo
*Assistant Examiner*—Louis K. Huynh
(74) *Attorney, Agent, or Firm*—Herbert Dubno; Andrew Wilford

(57) ABSTRACT

A baler has a front door assembly formed with an upper loading port and a loading door engageable in a closed position over the loading port. A plurality of guides on the assembly define respective generally vertical paths along which can travel respective elements on the door between an upper position corresponding to a closed position of the door and a lower open position with the door offset from the loading port. The door lies wholly with an outline of the door assembly in the lower open position. The baler door wherein the guides are generally vertical and horizontally flank the door. Each guide is formed of three pieces and forms a respective upper track and a lower track therebelow and the elements include respective upper and lower elements riding in the tracks. Each lower track is formed with a horizontally extending rest on which the respective lower element sits in the open position and with another horizontally extending rest on which the respective lower element sits in the closed position. In addition each upper track has an upper end in which the respective upper element is engaged in the closed position.

12 Claims, 9 Drawing Sheets

DOOR ASSEMBLY FOR WASTE-PAPER BALER

FIELD OF THE INVENTION

The present invention relates to a baler. More particularly this invention concerns a door assembly for a vertical-shaft waste-paper baling press.

BACKGROUND OF THE INVENTION

A standard waste-paper baler has a housing defining a vertically extending normally square-section shaft into which waste paper or the like to be baled is loaded and in which a piston can travel vertically from an uppermost position to a lower position pressing the mass in the shaft into a compacted ball at the base of the shaft. Normally the housing is provided with a loading door at the upper region of one of its side walls so that when the piston is in the uppermost position this door can be opened to load material to be compacted into the baler through a loading port exposed when the door is opened. Such systems are described in my U.S. Pat. Nos. 5,170,702 and 5,685,219.

In German 297 042 76 such a system is described where the loading-port door is pivoted about a horizontal axis on its upper edge so that when opened it extends upward from the baler. This has the advantage of getting the door out of the way during the loading operation, but requires that the baler be installed somewhere there is adequate room to accommodate it and its door when in the open condition, that is there must be considerable clear headroom above the baler. In addition once the door is open on such a baler the port does not present itself for easy loading through it of the normally randomly arranged material to be baled. In fact in some models the door actually makes it more difficult to approach the loading port and pass material through it.

OBJECTS OF THE INVENTION

It is therefore an object of the present invention to provide an improved baler.

Another object is the provision of such an improved baler which overcomes the above-given disadvantages, that is whose door is easy to open, takes up little space when opened, and whose port is convenient to load.

SUMMARY OF THE INVENTION

A baler has a front door assembly formed with an upper loading port and a loading door engageable in a closed position over the loading port. A plurality of guides on the assembly define respective generally vertical paths along which can travel respective elements on the door between an upper position corresponding to a closed position of the door and a lower open position with the door offset from the loading port. The door lies wholly with an outline of the door assembly in the lower open position. The guides are generally vertical and horizontally flank the door.

Thus with this system the press can be installed between and beneath other items, even recessed in a wall, and still will be fully accessible. When the door is opened it does not extend above, below, or to either side of the baler so that it offers no encumbrance to adjacent equipment. Furthermore since the door slides instead of pivoting, it can lie flush against the front of the machine when open so that it is very much out of the way.

According to the invention the port has a flat and horizontal lower edge and the door has a flat and horizontal upper edge substantially coplanar with the port edge in the open position of the door. Thus these surfaces form in effect a work table over which material being loaded into the baler can be pushed.

Each guide in accordance with the invention is formed of three pieces and forms a respective upper track and a lower track therebelow and the elements include respective upper and lower elements riding in the tracks. Each lower track is formed with a horizontally extending rest on which the respective lower element sits in the open position and with another horizontally extending rest on which the respective lower element sits in the closed position. In addition each upper track has an upper end in which the respective upper element is engaged in the closed position.

A latch is engageable between the door and the assembly for retaining the door in the closed position. This latch includes a pair of retaining pins on the assembly flanking the door and a pair of dogs each pivotal on the door between a holding position engaged over the respective retaining pin and a freeing position clear of the respective retaining pin. An actuating handle extending between the dogs connects same together for joint pivoting. An operating rod extending horizontally on the door serves as a handle for raising and lowering the door and also as a pivot for the dogs.

Biasing means connected to the door generally cancel out a weight of the door as it is moved between its positions. This means includes a counterweight, a flexible element having one end connected to the counterweight and an opposite end connected to the door, and a deflecting wheel mounted on the assembly above the port. The flexible element passes over the wheel. In addition the door includes at least one hollow and vertical frame member and the counterweight is inside the hollow frame member.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
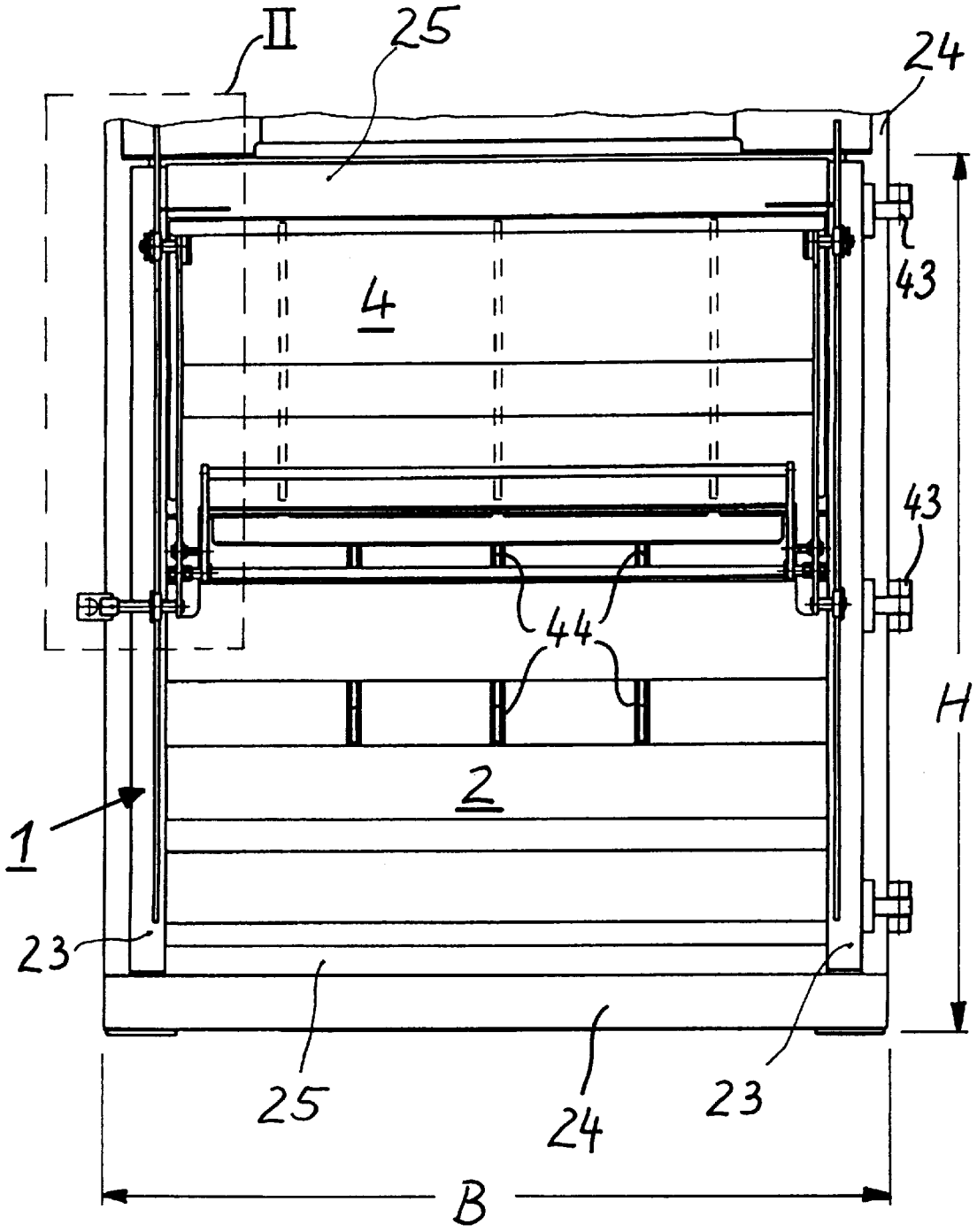
FIG. 1 is a front view of a baler according to the invention.
Figure 2:
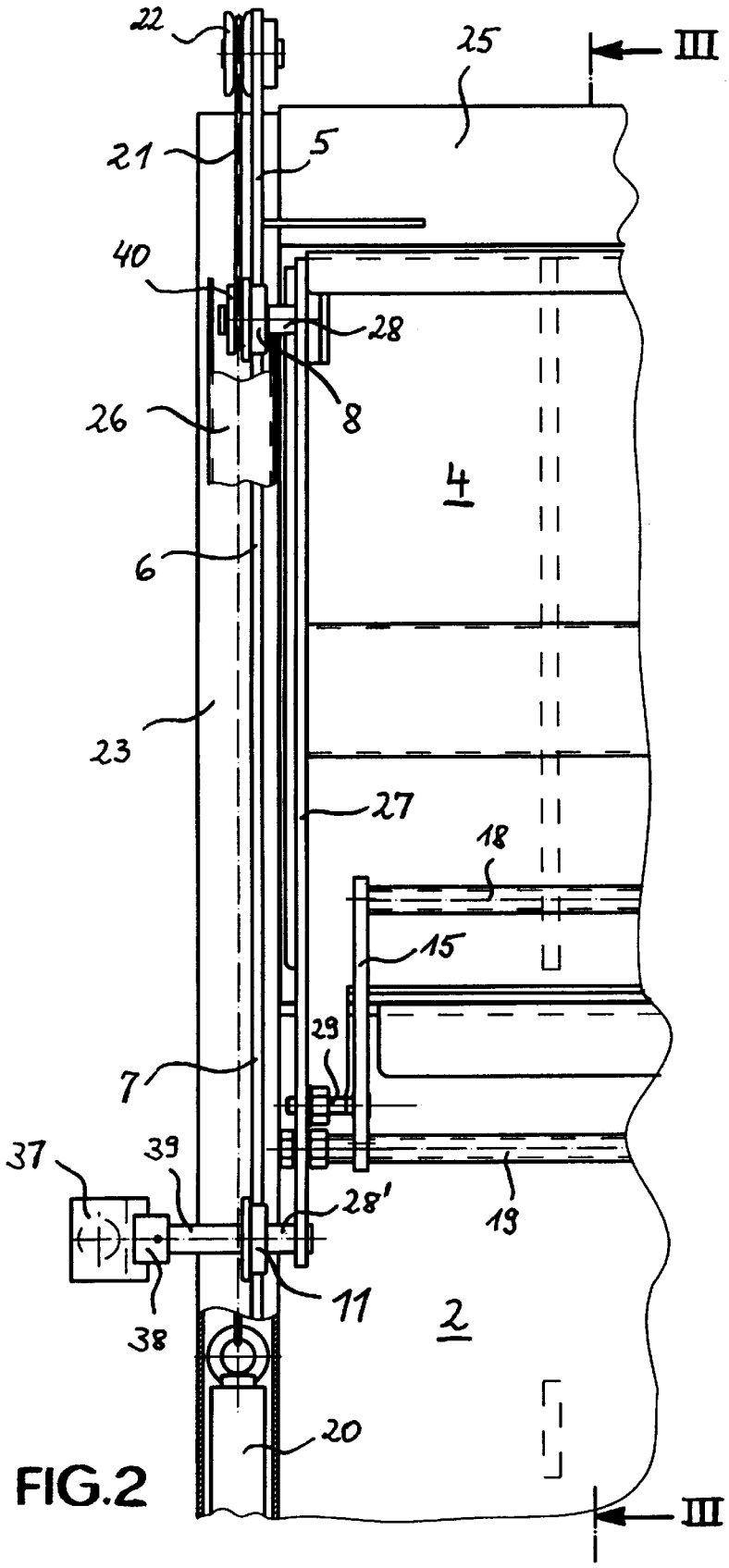
FIG. 2 is a larger-scale view of the detail indicated at II in FIG. 1.
Figure 7:
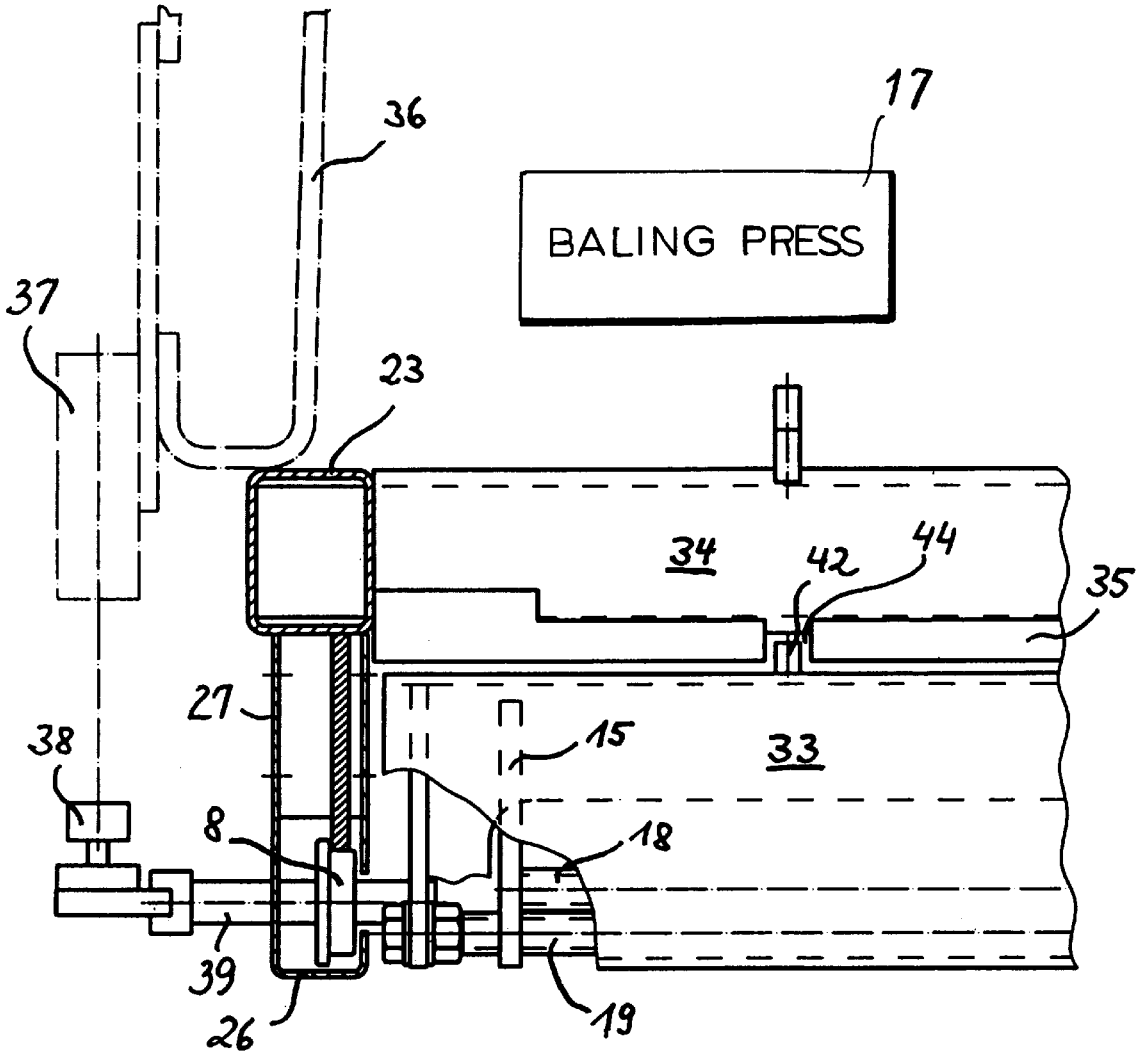
FIG. 7 is a section taken along line VII—VII of FIG. 6.
Figure 9A:
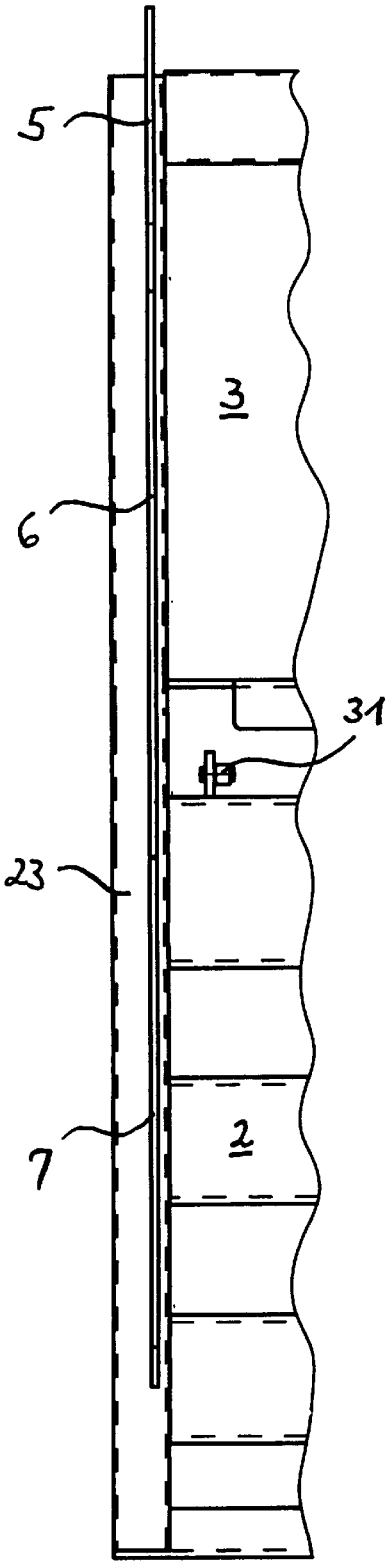
FIGS. 9A and 9B are front and side views of one of the door tracks.
Figure 9B:
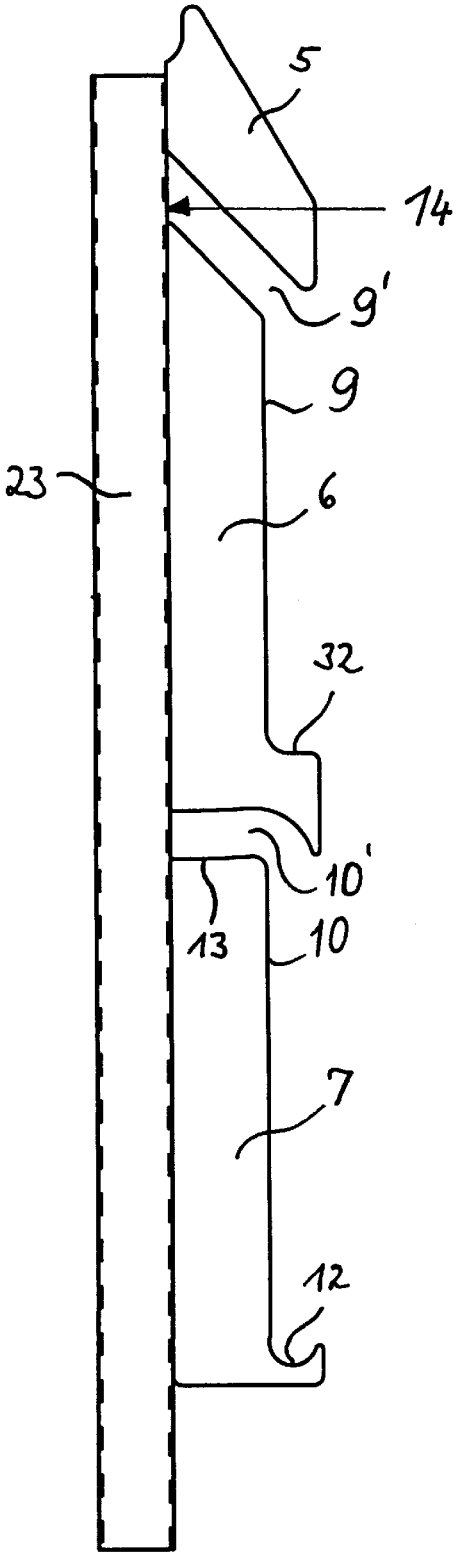

As seen in FIGS. 1 and 2 a door assembly 1 for a baling press 17 (FIG. 7 only) has a height H and a width B and is pivotal in toto about a vertical axis defined by side-edge hinges 43 so that a compacted bale can be removed from it. The door assembly 1 has a rigid lower panel 2 underneath a loading port 3 covered when the baler 17 is operating by a loading door 4 and has a frame 24 formed mainly by vertical and horizontal square-section members 23 and 25. Each side of the door assembly 1 has three guide plates 5, 6, and 7 defining upper and lower guide paths or tracks 9 and 10 for respective upper and lower rollers B and 11 mounted by respective axles 28 and 28' on the door 4. Front plates 26 forwardly close the tracks 9 and 10 so that the wheels 8 and 11 are captured therein. The upper track 9 has an upper portion 9' extending at about 45° to the vertical and ending at a surface 14 (FIG. 9B) and a lower end forming a rest 32 and the lower track 10 has a horizontally extending upper portion 10' with a lower support surface 13 and a lower end forming a rest 12.

Each wheel 8 as shown in FIG. 2 is provided with a coaxial anchor wheel 40 to which one end of a respective cable 21 is connected. Each cable 21 passes over a deflecting sheave 22 mounted on the door frame member 25 and has an opposite end connected to a respective counterweight 20 riding inside the respective member 23. The total weight of the counterweights 20 is about equal to that of the door 4 so that same can be moved vertically with ease. The counterweighting is such that, taking into account the normal friction of the door 4 in the tracks 9 and 10, the door 4 can be stopped and will sit stably at any of the vertically offset positions described below.

Figure 8A:
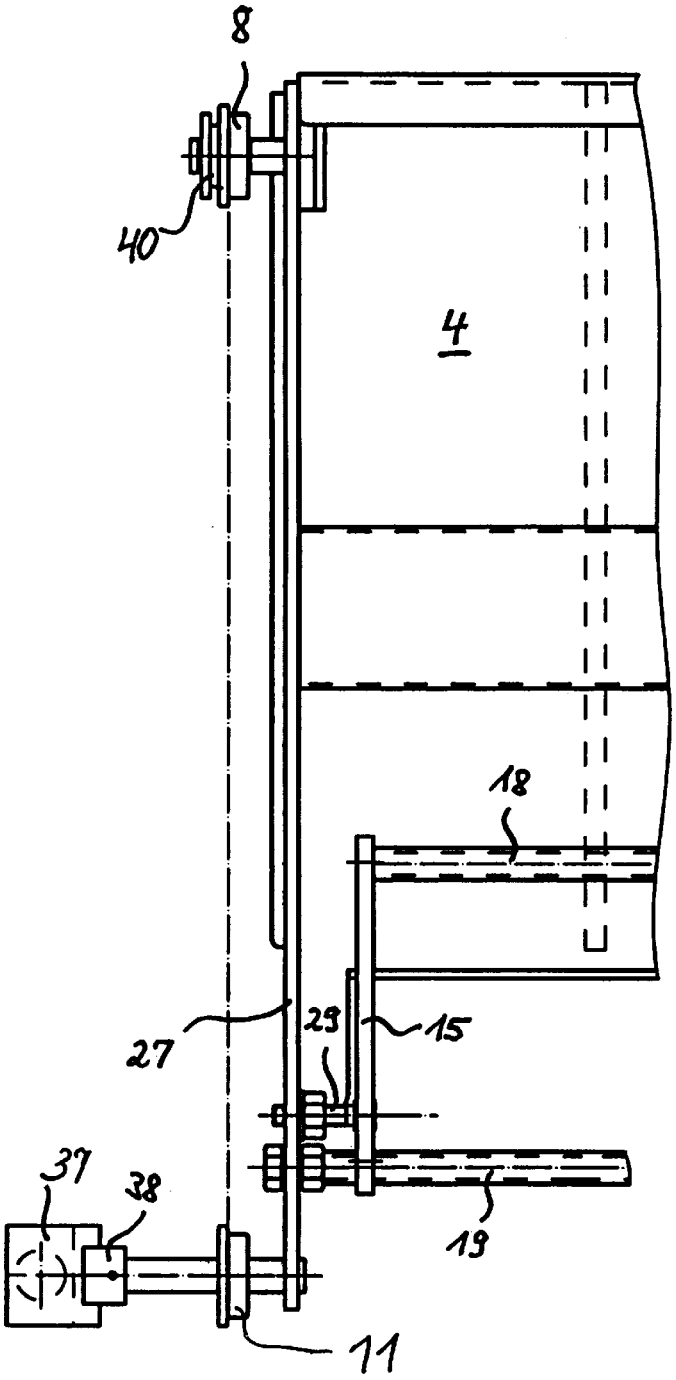
FIGS. 8A and 8B are front and side views of details of the door mechanism.
Figure 8B:
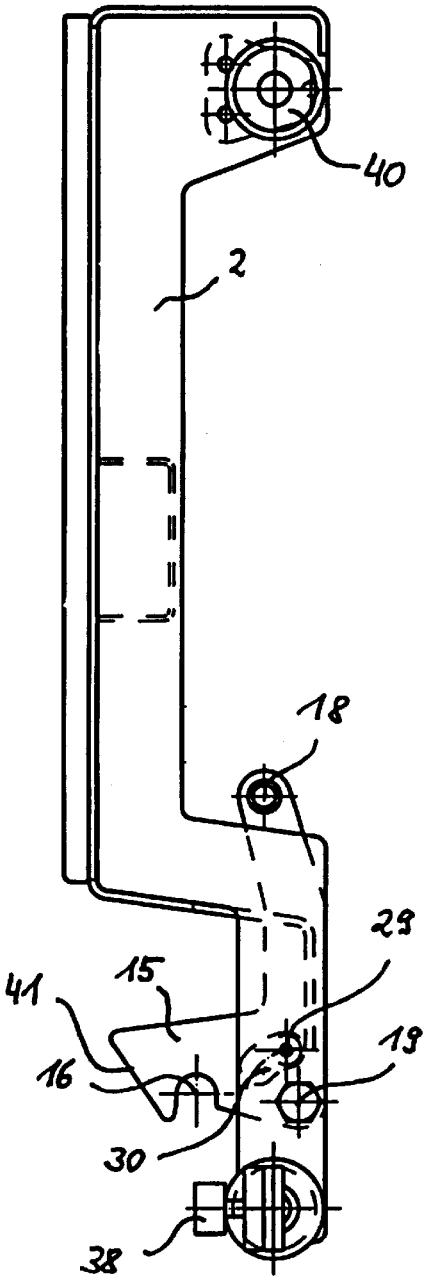

A pair of L-shaped latch dogs 15 also shown in FIGS. 8A and 8B are pivotal on a common horizontal lifting shaft 19 fixed. in end flanges 27 of the door frame 24 and are interconnected by an actuating rod or handle 18. Each such dog 15 has an end camming surface 41 and a laterally open notch 16 engageable with a respective retaining bolt 31 (FIG. 9A only) fixed to the door assembly 1 beneath the port 3. In addition each dog 15 is formed with an arcuate slot 30 centered on the axis of the pivot rod 19 and receiving a short pin 29 projecting from the respective side plate 27 so as to limit the arc through which the dog 15 can swing.

One of the shafts 28' is extended as a shaft 39 carrying a coded magnet 38 juxtaposable with a proximity switch 37 carried on a housing 36 of the baler 17. This switch 37 is connected to an unillustrated controller which prevents the baler from operating except in a closed position of the door 2 shown in FIG. 3.

In this closed position of the door 2 the notches 16 engage over the pins 31. The rollers 8 and 11 are at the outer ends of the upper sections 9' an 10' of the tracks 9 and 10 and the door 2 is perfectly vertical.

Figure 3:
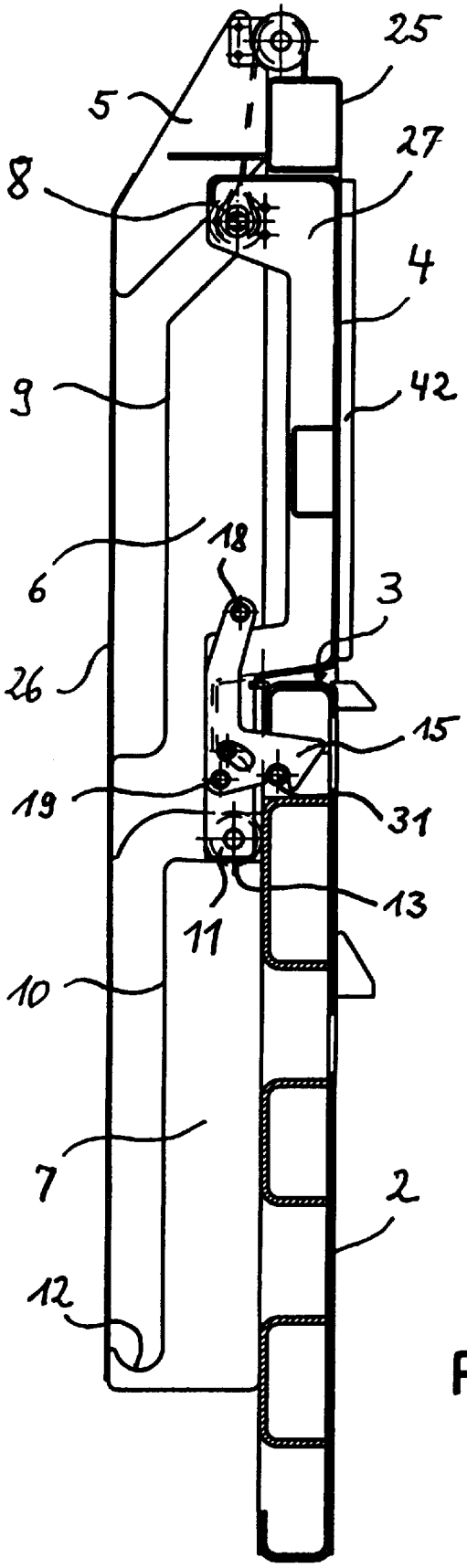
FIG. 3 is a section through the closed door taken along the line III—III of FIG. 2.
Figure 4:
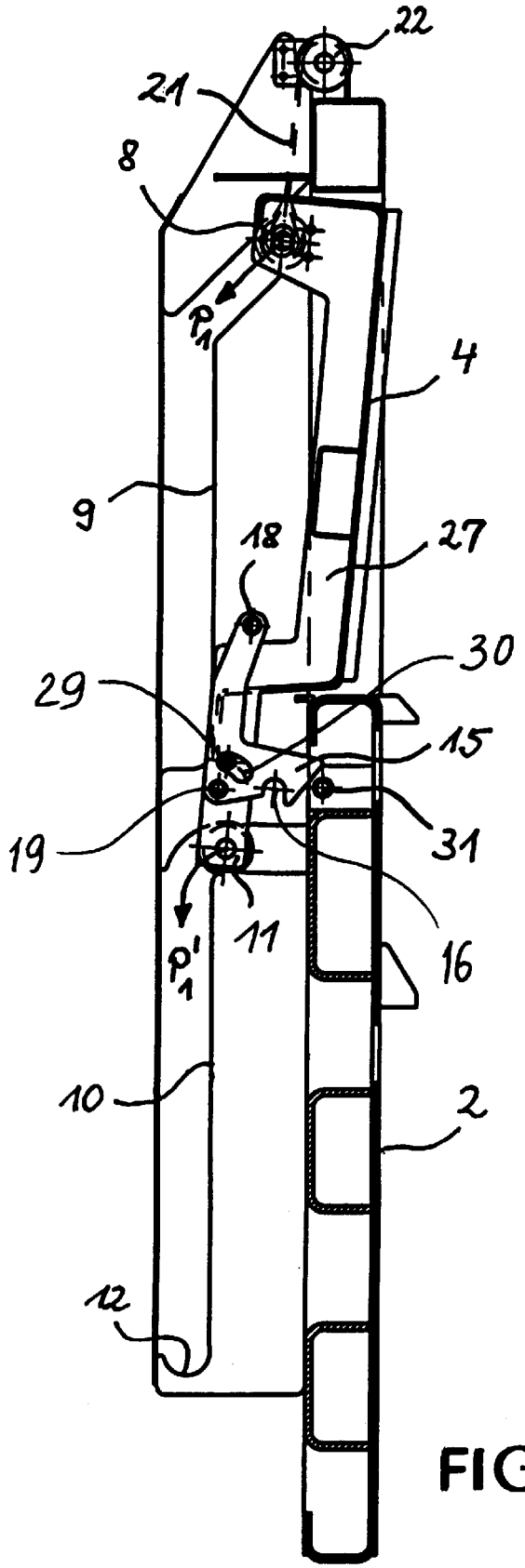
FIGS. 4, 5, and 6 are views like FIG. 3 but showing the loading door in succeeding positions as it opened.

To open the door 2 the user grips the handle rod 18 and pulls it outward, to the left in FIG. 3 so that the bottom rollers 11 ride outward on the surface 13 as shown in FIG. 4 while the top rollers 11 remain against the end surface 14 at the upper ends of the tracks 9. During this movement there is no significant vertical displacement of the door 2, only an outward pivoting of its lower end about the axis defined by the upper axles 28.

Figure 5:
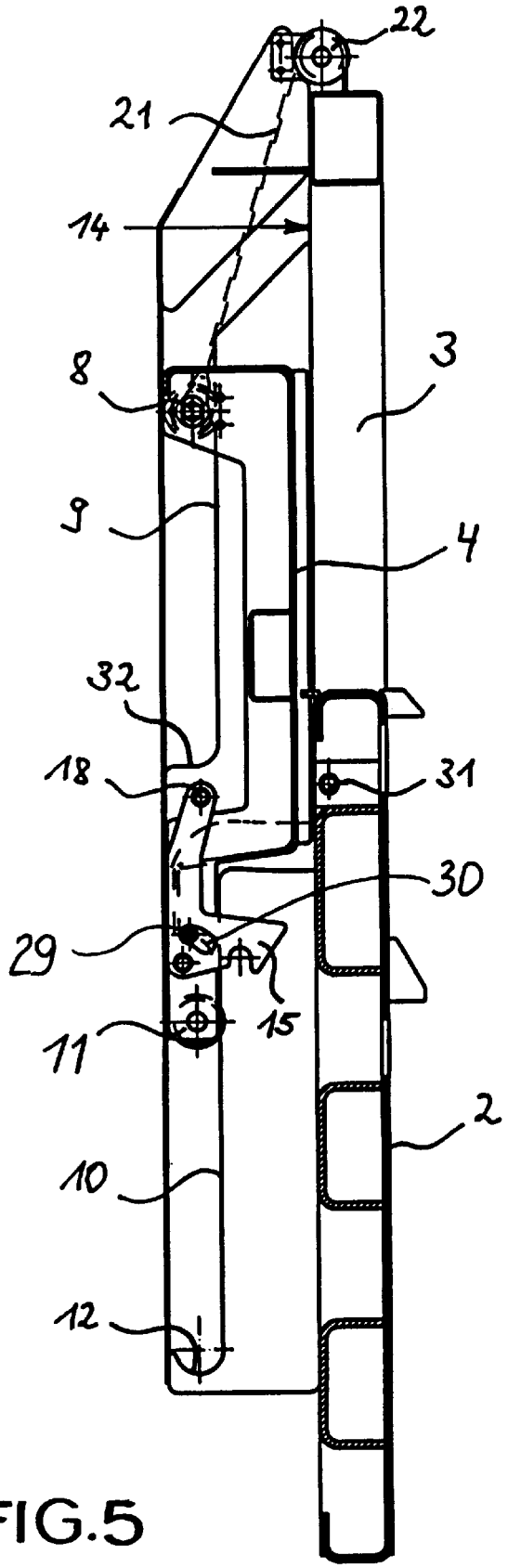

Once the lower rollers 11 pass into the vertical parts of the tracks 10 they can move downward as shown by arrow $P'_1$, pulling down the upper rollers 8 as shown by arrow $P_1$. This action continues until both upper rollers 8 are engaged in the vertical legs of the upper tracks 9 while the lower rollers 11 are engaged in the vertical legs of the lower tracks 10 as shown in FIG. 5. In this position the door 4 is again perfectly vertical but offset forward from the bottom door panel 2 and is moving freely but not rapidly because the counterweights 20 are moving up in the members 23.

Figure 6:
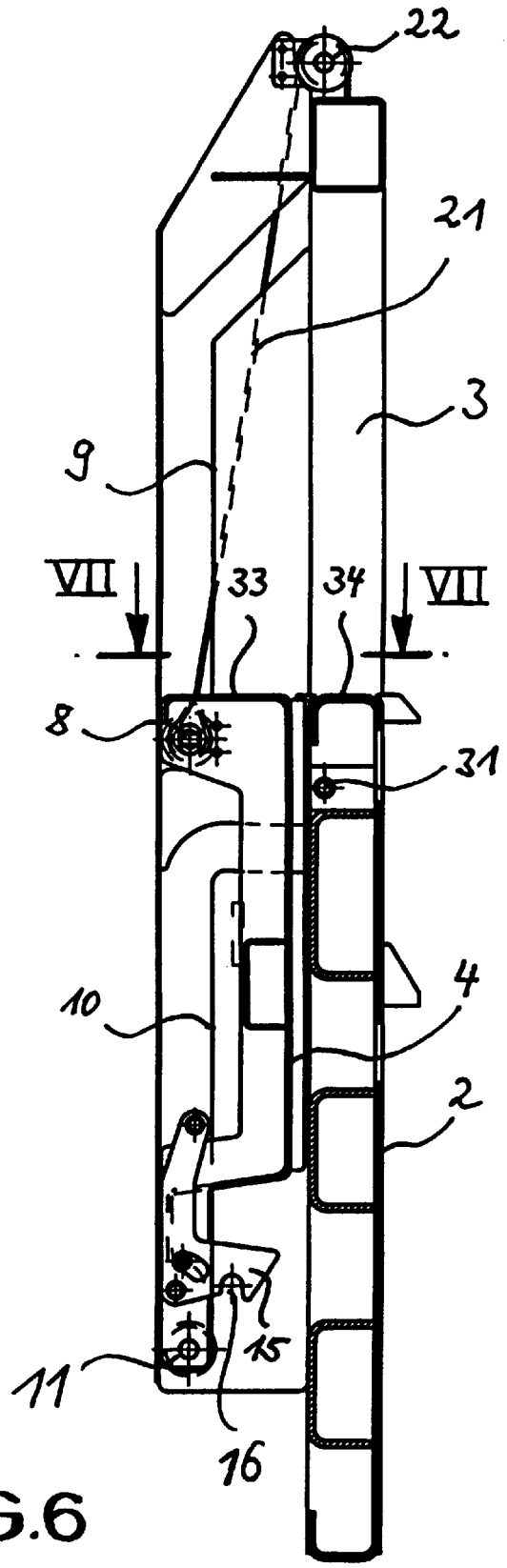

Downward movement continues until as shown in FIG. 6 the rollers 8 and 11 come to rest in the ends 32 and 12 of the respective tracks 9 and 10. In this position a planar upper edge 33 of the door 4 is coplanar with a planar lower edge 34 of the port 3. A molding 35 thereon extends out to minimize the gap between the two surfaces 33 and 34. In addition ridges 42 (FIGS. 3 and 7) on the back of the door 4 engage in slots 44 of the panel 2 so that material set on the coplanar surfaces 33 and 34 is not likely to slide down between the door 4 and the panel 2.

To close the door 4 the user grips the rod 19 and raises it to its upper position. Its rollers 8 and 11 slide back up in the tracks 9 and 10 to their upper end positions and, as the dogs 15 approach the pins 31 they are cammed out by engagement of these pins 31 with their end edges 41, after which they drop down to engage the notches 16 over these pins 31. The port 3 is again effectively closed and the baler 17 can operate to compact the just loaded material.

What is claimed is:

1. In a baler having a front door assembly formed with an upper loading port, the improvement comprising:

a loading door engageable in a closed position over the loading port;

a plurality of generally vertical guides on the assembly flanking the door, defining respective generally vertical paths, and each having a respective upper track and a lower track there below; and respective upper and lower elements on the door engaged in the tracks and displaceable therealong between an upper position corresponding to a closed position of the door and a lower open position with the door offset from the loading port.

2. The baler defined in claim 1 wherein each lower track is formed with a horizontally extending rest on which the respective lower element sits in the closed position.

3. The baler defined in claim 2 wherein each upper track has an upper end in which the respective upper element is engaged in the closed position.

4. The baler defined in claim 1, further comprising latch means engageable between the door and the assembly for retaining the door in the closed position.

5. The baler defined in claim 4 wherein the latch means includes a pair of retaining pins on the assembly flanking the door, and a pair of dogs each pivotal on the door between a holding position engaged over the respective retaining pin and a freeing position clear of the respective retaining pin.

6. The baler defined in claim 5 wherein the latch means further comprising an actuating handle extending between the dogs and connecting same together for joint pivoting.

7. The baler defined in claim 6, further comprising an operating rod extending horizontally on the door.

8. The baler defined in claim 7 wherein the dogs are pivoted on the operating rod.

9. The baler defined in claim 1, further comprising counterweight means connected to the door for generally canceling out a weight of the door as it is moved between its positions.

10. The baler defined in claim 9 wherein the counterweight means includes a counterweight, a flexible element having one end connected to the counterweight and an opposite end connected to the door, and a deflecting wheel mounted on the assembly above the port, the flexible element passing over the wheel.

11. The baler defined in claim 10 wherein the door includes at least one hollow and vertical frame member, the counterweight being inside the hollow frame member.

12. The baler defined in claim 1 wherein the port has a flat and horizontal lower edge and the door has a flat and horizontal upper edge substantially coplanar with the port lower edge in the open position of the door.

* * * * *